US007074131B1

(12) United States Patent
Renaud

(10) Patent No.: US 7,074,131 B1
(45) Date of Patent: Jul. 11, 2006

(54) GOLF GRIP KIT AND SWING EXERCISE DEVICE

(76) Inventor: Henry Renaud, 6254 No. 7 Riverwalk La, Jupiter, FL (US) 33458

( * ) Notice: Subject to any disclaimer, the term of this patent is extended or adjusted under 35 U.S.C. 154(b) by 0 days.

(21) Appl. No.: 11/121,474

(22) Filed: May 3, 2005

(51) Int. Cl.
*A63B 69/36* (2006.01)
*A63B 21/00* (2006.01)

(52) U.S. Cl. ..... 473/219; 473/229; 482/129

(58) Field of Classification Search ..... 473/213–229, 473/258; 482/123, 129; D21/662
See application file for complete search history.

(56) References Cited

U.S. PATENT DOCUMENTS 2,085,320 A * 6/1937 Kolstrand ..... 43/42.72
2,788,214 A * 4/1957 Tilden ..... 473/213
3,083,016 A * 3/1963 Sumegi ..... 473/229
3,618,942 A * 11/1971 Bates et al. ..... 482/129
5,007,635 A * 4/1991 Tiller ..... 482/129
5,112,287 A * 5/1992 Brewer ..... 482/130
D451,157 S * 11/2001 Brookes ..... D21/662
6,558,302 B1 * 5/2003 Cluff ..... 482/129
D501,899 S * 2/2005 Shute, Jr. ..... D21/692
6,910,973 B1 * 6/2005 Kuster ..... 473/219

* cited by examiner

*Primary Examiner*—Nini F. Legesse
(74) *Attorney, Agent, or Firm*—McHale & Slavin, P.A.

(57) ABSTRACT

A golf swing exercise device for use with conventional flexible cable weight machines. The exercise device allows an individual to exercise both the back and forward swing and strength their golf grip. The device permits the individual to use the same golf grip utilized by the individual on the golf course wherein the addition of moisture would allow the individual to determine if their golf grip is strong enough to prevent club twisting under resistance conditions.

8 Claims, 2 Drawing Sheets

GOLF GRIP KIT AND SWING EXERCISE DEVICE

FIELD OF THE INVENTION

This invention pertains to exercise devices and in particular to a golf grip and swing exercise device capable of adding a resistance on a golf grip handle to provide rotational movement reinforcement forward swing, back swing, and golf grip.

BACKGROUND OF THE INVENTION

The modern game of golf is based was invented in the 15$^{th}$ century along the links of the Scottish coast line. The game is based upon the use of various clubs to advance a ball into a "cup" on each of 18 different holes of a golf course. Each swing a golfer takes at the ball is considered a "stroke" and is counted toward the total score. The number of strokes a player takes through an entire round of golf is the player's score. The player with the lowest score wins the golf game.

In order to properly play golf, a player must be able to advance the golf ball predictable distances. Clubs known as "woods" are large headed clubs used for advancing the golf ball a long distance while "irons" are flat steel faced clubs used for shorter distances. Common to all players and necessary for advancing the golf ball requires that the player be able to consistently execute three fundamental aspects of the game; namely the stance, the grip and the swing.

The stance of a player requires that the shoulders and feet must be square with the ball and the feet firmly planted. This is known as "addressing" the ball and is necessary for the player to be able to repeat body positioning for each swing.

The grip requires both hands clasped around the club handle wherein pressure is exerted by the last three fingers on the left hand (for right handed players) and two middle fingers on the right hand. Many players further link the little finger on the front right hand under the forth finger on the back left hand. The grip must also be repeatable so that the player develops a consistency with feet and hand positioning.

The swing is the final but equally important component requiring the golfer to and swing the club across their body and over the shoulder. The player must keep their head down while swinging the club as the face strikes the ball and followed through by allowing the club head to wrap around the opposite shoulder.

The ability to play well requires that the individual practice the swing. The more the individual practices the swing the better the body will be to accommodate such movement to the point it becomes predictable allowing the individual to use different clubs of different weights and sizes, with nearly the same swing, allowing for predictability of ball advancement distances. In this respect, an individual who has developed a good swing may be able to use the same swing wherein the use of a driver may be used to advance the ball 300 yards while the use of 6 iron with the same swing can be used to advance a ball 185 yards.

Once an individual has adapted a swing to the point it is a natural trained function, such as walking, then the individual can concentrate on various other factors that would affect ball placement such as wind, sand and water hazards, trees, hilly terrain, and so forth.

The problem arises in that the ability to practice the swing, stance and grip while off the course is limited to practice ranges and a number of exercise devices that are directed in an effort to assist an individual in adjustment of the swing.

U.S. Pat. No. 3,966,203 discloses a resistance type device that attaches a net around the head of the club and, by using a weight that is attached to a line, imparts a resistance to the swing. This device does not allow for the exercise of a natural swing as the use of any resistance at the end of the club introduces a cantilever extension that may impart a twist to the player's swing.

U.S. Pat. No. 2,847,234 employs an elastic member which attaches to the golf grip to resist the golfer's swing.

U.S. Pat. No. 6,558,302 discloses a muscle training and development device providing resistance at the distal end of the grip. This device does permit exercise indoors as the length of the club handle permits indoor swinging.

U.S. Pat. No. 4,229,002 discloses yet another golf club handle for use indoors having a line attached to the distal end of the grip. This device develops a similar swing as the upper mentioned patents by attaching resistance to the distal end of the grip and in this particular case a series of pulleys provides a weight at the end of the line for the resistance.

U.S. Pat. No. 5,947,835 discloses a golf training and exercise device wherein a flexible, soft grip is attached to one end of the elastic band purposes of developing the hand grip.

U.S. Pat. No. 5,039,091 discloses an elaborate exercise machine having a fly wheel with the variable resistance in order to provide resistance for assisting in golf swings, baseball bat swings, canoeing strokes, football kicks, tennis serves and so forth.

U.S. Pat. No. 4,984,801 discloses a golf swing muscle strengthener and swing developer which has a structural member secured to a golf club wherein weights are suspended from the members so that they are directly below the golfer's grip to provide resistance through a controlled range.

U.S. Pat. No. 5,125,882 discloses a resistance exercise device for strengthening a golf swing. The golf club is attached to a telescoping rod that allows the golf club to engage resistance as rotated around a pivot point.

U.S. Pat. No. 6,579,214 discloses a golf exercise and training apparatus which employs a L-shaped member to transfer resistance from a plurality of pulleys and cables on stacks of weights to a hand hold bar.

The prior art devices all require engagement of a full club making it impractical for indoor use or when a partial club is used, attachment only to a distal end limiting the benefit of the device.

SUMMARY OF THE INVENTION

The instant invention is a kit for converting a golf club into a golf exercising device, or alternatively, providing a pre-manufactured golf exercising device. The device consists of the handle end of a golf club shaft wherein approximately 14 inches of a shaft is employed wherein a regulation golf grip is attached. In accordance with the kit embodiment, an eye hook is located on one end of the shaft and secured by use of a threaded rod that extends through the center of the shaft and couples to the opposing eye hook by use of threaded couplers.

An objective of the invention is to provide a kit for converting a golf club into an exercise device.

Another objective of the instant invention is to provide a golf club exercise device that permits the exchange of grips allowing an individual to simulate actual playing club feel.

Still another objective of the instant invention is to provide an exercise device that can be used with a conventional weight machine.

Yet another objective of the instant invention is to provide an exercise device having proximal and distal eye hooks that allow for exercise of both forward and back swings providing swing and grip exercises by separate attachments.

Other objectives and advantages of this invention will become apparent from the following description taken in conjunction with the accompanying drawing wherein are set forth, by way of illustration and example, certain embodiments of this invention. The drawings constitute a part of this specification and include an exemplary embodiment of the present invention and illustrate various objectives and features thereof.

DETAILED DESCRIPTION OF THE PREFERRED EMBODIMENT

Figure 1:
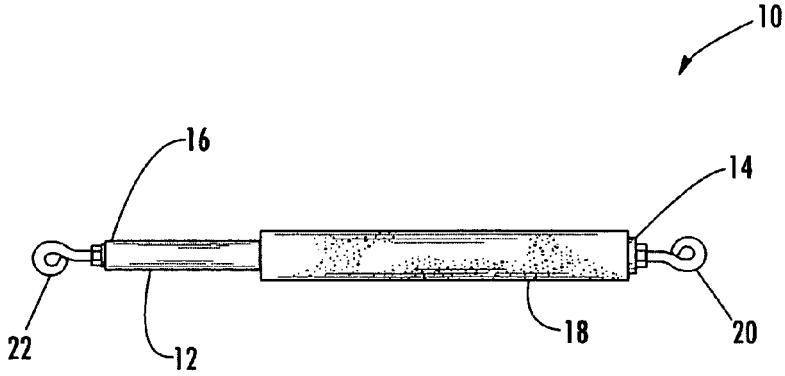
FIG. 1 is a plan view of the golf grip kit of the instant invention.

Now referring to FIG. 1, set forth is a side view of the device 10 having a shaft 12 defined by a proximal end 14 and distal end 16. The shaft is typically constructed of steel or graphite and can be formed from a retired golf club by cutting the shaft approximately 13 inches from the proximal end 14.

A hand grip 18 is depicted on the shaft, the hand grip may be an existing grip found on a golf club or later mounted thereto providing the individual with the same grip that the individual has on their current playing clubs. The use of a like grip allows the individual to exercise on a device that is similar to the type of device to the type of grip he is utilizing. This includes the ability to recognize the grip as the individual adjusts to different conditions including moisture on the grip wherein an individual can check the grip type for resistance during twist in the individuals hand, as well as determination of whether a golfer's glove is suitable for the individual in view of the glove.

The proximal end includes an eye hook 20 having an aperture sized to permit ease of attachment to the hooked end of a conventional flexible cable exercise device. Similarly, along the distal end 16, a second eye hook 22 is positioned The proximal eye hook 20 therein allows for coupling when the individual attends to developing of the back swing, while the distal end eye hook 22 permits the individual to attach to the conventional cable exercise machine for the developing of the power stroke. Altering the attachment positions on an exercise device allows the individual to strengthen their grip by presenting a different twisting torque by alternating attachment to each eye hook 20 and 22.

Figure 2:
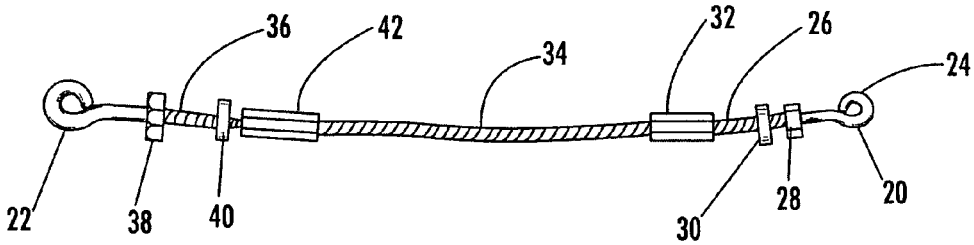
FIG. 2 is a plan view of the eye hooks and coupler.

As shown in FIG. 2, set forth is the proximal end eye hook 20 which consists of the eye hook 24 having a shank 26 with lock nut 28 and washer 30. The shank 26 is threaded to coupler 32 on one end with the opposite end receiving threaded rod 34. On the distal end, the eye hook 22 is shown with shank 36 having lock nut 38 and washer 40. Similarly, coupler 42 couples a shank 36 to the threaded rod 34. The threaded rod allows for customization when sold as a kit should the golfer decide to use an old club and mis-measure slightly the rod can be trimmed accordingly. Preferably washer 40 is rounded so as to enclose the distal end of the shaft 12. It should be noted that while the use of a threaded rod with two couplers is the preferred means for coupling the first eye hook to the second eye hook, alternative coupling methods allow for each eye hook to formed from female couplers wherein only a threaded rod there between is necessary. Alternatively, the rod may include female couplers and threaded eye hooks secured to the female couplers. Still another embodiment is to employ eye hooks have elongated male or female shanks and coupling to a second eye hook with the reverse coupler. Variations of this coupling is considered to be included by reference in this specification.

Figure 3:
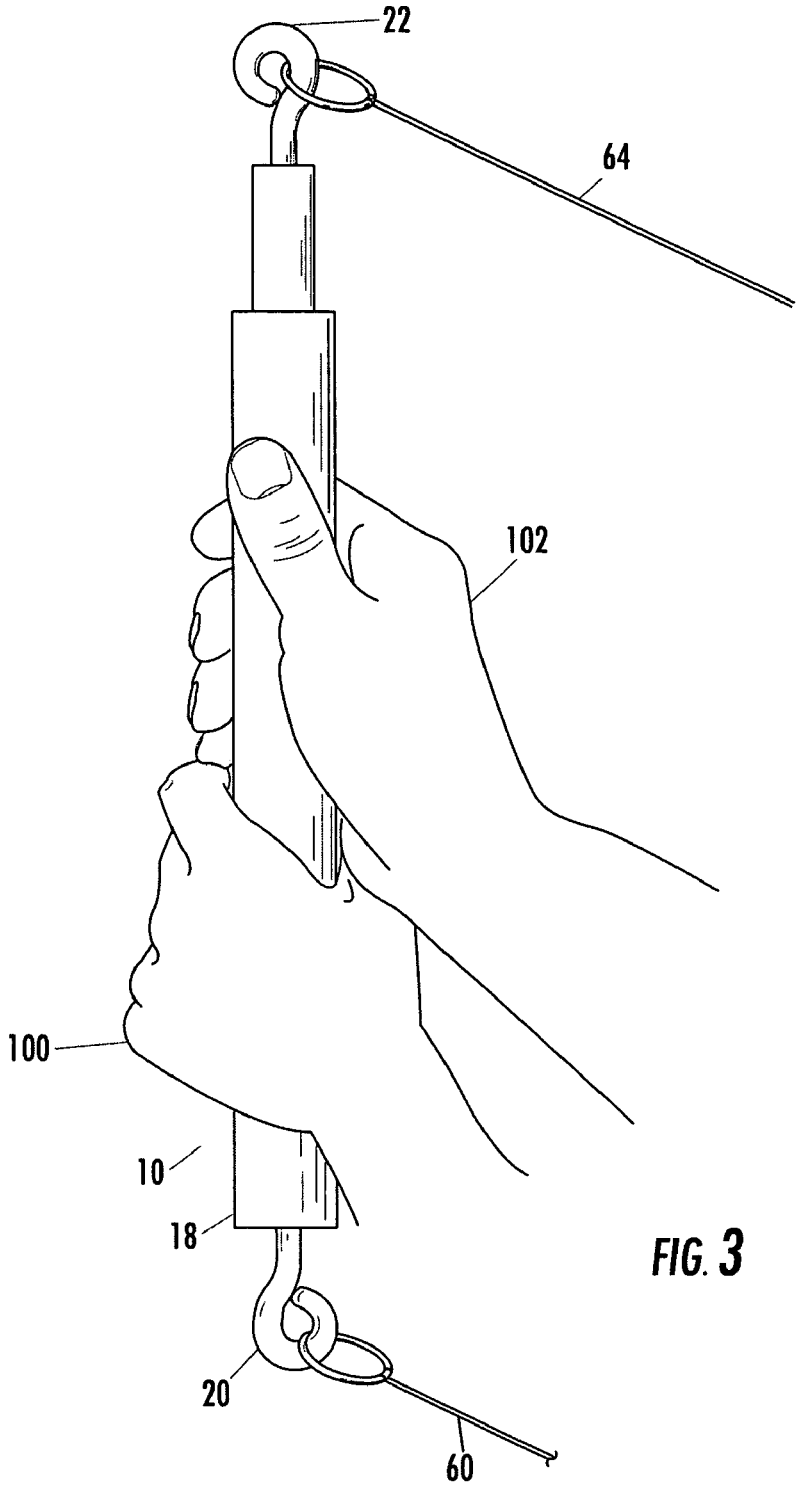
FIG. 3 is a pictorial view of the golf grip kit attached to an exercise device.

FIG. 3 depicts the device 10 with an individual's left hand 100 and right hand 102 placed around the grip 18. The proximal end 20 is secured to a flexible cable 60 that allows the individual to adjust and exercise the back stroke common to the game of golf. Alternatively, the distal end 22 is coupled to a cable 64 wherein the golfer can adjust the power stroke.

In this manner, the individual can utilize the grip of their choice. For instance, when an individual regrips his clubs he may also regrip the exercise device with a similar grip providing a common field between the exercise device and the actual club. Alternatively, an individual may try out different grips under resistance.

The exercise device then can be used on conventional weight machines using either the distal end or the proximal end for attachment to the weight machine using a golf grip that the player is accustomed to. The eye hook on the proximal end provides a unique training aspect as it provides a more realistic feel during a back swing providing resistance the individual's body without the twisting affect common with placement of a resistance on the proximal end. However, as in previous formats the attachment to the proximal end allows for a down swing should the individual wish to work on the power stroke.

It is to be understood that while I have illustrated and described certain forms of my invention, it is not to be limited to the specific forms or arrangements of parts herein described and shown. It will be apparent to those skilled in the art that various changes may be made without departing from the scope of the invention and the invention is not to be considered limited to what is shown in the drawings and described in the specification.

What is claimed is:

1. An exercise device kit comprises:

a handle section of a golf club, said handle section defined as a shaft having length formed by a proximal end and a distal end with a golf grip secured to said proximal end;

a first eye hook positionable along said proximal end;

a second eye hook positionable along said distal end; and a means for coupling said first eye hook to said second eye hook;

wherein said eye hooks are available for alternate attachment to a flexible cable on a weight resistance machine whereby an individual can adjust resistance to strengthen the individual's grip and provide swing exercising.

2. The kit according to claim 1 wherein said shaft is approximately 14 inches long.

3. The kit according to claim 1 wherein said shaft is hollow.

4. An exercise device comprising:

a handle section of a golf club, said handle section defined as a hollow shaft having length formed by a proximal end and a distal end with a golf grip secured to said proximal end;

a first eye hook having a threaded shank positionable along said proximal end;

a first union coupler secured to said threaded shank of said first eye hook;

a second eye hook having a threaded shank positionable along said distal end;

a second union coupler secured to said threaded shank of said second eye hook;

a threaded rod secured to said first and second eye hook; wherein said eye hooks are secured to each other through said hollow shaft and are available for alternate attachment to the flexible cable on a weight resistance machine whereby an individual can adjust resistance to strengthen the individual's grip and provide swing exercising.

5. The exercise device according to claim 4 wherein said threaded rod can be trimmed in length.

6. The exercise device according to claim 4 including a lock nut positioned on the shank of said first eye hook to allow for variations in shaft length.

7. The exercise device according to claim 4 including a lock nut positioned on the shank of said second eye hook to allow for variations in shaft length.

8. The exercise device according to claim 4 wherein said shaft is approximately 14 inches in length.

* * * * *